United States Patent [19]

Hafele et al.

[11] Patent Number: 4,576,130

[45] Date of Patent: Mar. 18, 1986

[54] FUEL INJECTION PUMP FOR INTERNAL COMBUSTION ENGINES

[75] Inventors: Walter Hafele, Fellbach; Peter Knorreck, Weissach, both of Fed. Rep. of Germany

[73] Assignee: Robert Bosch GmbH, Stuttgart, Fed. Rep. of Germany

[21] Appl. No.: 680,970

[22] Filed: Dec. 12, 1984

Related U.S. Application Data

[63] Continuation-in-part of Ser. No. 671,264, Nov. 14, 1984, abandoned.

[30] Foreign Application Priority Data

Nov. 24, 1984 [DE] Fed. Rep. of Germany ..... 3442953

[51] Int. Cl.[4] ..... F02M 39/00

[52] U.S. Cl. ..... 123/372; 123/364; 123/357

[58] Field of Search ..... 123/364, 372, 365, 357, 123/358, 359

[56] References Cited

U.S. PATENT DOCUMENTS

| | | | |
|---|---|---|---|
| 3,025,843 | 3/1962 | Wagner | 123/372 |
| 3,698,369 | 10/1972 | Vvaille | 123/364 |
| 4,270,502 | 6/1981 | Seilly | 123/357 |
| 4,355,608 | 10/1982 | Purcell | 123/372 |
| 4,407,245 | 10/1983 | Eheim | 123/359 |
| 4,425,889 | 1/1984 | Hachitani | 123/357 |
| 4,495,914 | 1/1985 | Ishii | 123/372 |

FOREIGN PATENT DOCUMENTS

| | | | |
|---|---|---|---|
| 629921 | 4/1936 | Fed. Rep. of Germany | 123/372 |
| 2855812 | 6/1979 | Fed. Rep. of Germany | 123/358 |
| 555362 | 8/1943 | United Kingdom | 123/372 |

*Primary Examiner*—Carl Stuart Miller
*Attorney, Agent, or Firm*—Edwin E. Greigg

[57] ABSTRACT

A fuel injection pump for internal combustion engines is disclosed, in which a profiled governor rod of a supply quantity adjusting member, the latter controlled by a final control element, is extended at its end toward the final control element out of the pump housing and is supported in a displaceable manner at the point where it emerges. For the sake of sealing the support point, a cylindrical slide bearing sheath is secured in the pump housing at the location where the governor rod emerges from the pump housing. A cylindrical governor rod guide means which is joined to the profiled governor rod and closes it off or surrounds it in a sealing manner is guided displaceably, with the least possible play, in the slide bearing sheath.

14 Claims, 8 Drawing Figures

FUEL INJECTION PUMP FOR INTERNAL COMBUSTION ENGINES

BACKGROUND OF THE INVENTION

This application is a Continuation-In-Part of application Ser. No. 671,264 filed Nov. 14, 1984, now abandoned.

The invention relates to a fuel injection pump for internal combustion engines comprising a pump housing and a supply quantity adjusting member controlled by an electromagnetic final control element, said supply quantity adjusting member having a profiled governor rod supported in said pump housing, said rod further having an end arranged to extend out of the pump housing toward the final control element.

In a known fuel injection pump of this type, the axially moved governor rod having an angular profile is supported by means of two bushings held in the ends of the pump housing and having sliding guides adapted to the angular shape of the profiled governor rod. While the bushing disposed on the end of the profiled governor rod remote from the final control element is sealed in a fluid-tight manner with a cap screwed into the pump housing, it is difficult to effect a seal at the passage of the profiled governor rod through the other bushing on the end toward the final control element, and over a relatively long period of operation such a seal is unreliable. Yet it is absolutely critical to prevent the escape of fuel, particularly when electromagnetic final control elements are used. Furthermore, tightness of the passage and difficulty in moving the profiled governor rod go hand in hand. (U.K. Pat. No. 941,784)

OBJECT AND SUMMARY OF THE INVENTION

The fuel injection pump according to the invention has the advantage over the prior art of having a reliable and satisfactory long-term seal. The cylindrical slide bearing sheath with the cylindrical slide or guide means guiding the profiled governor rod enables small manufacturing tolerances, which in turn guarantees not only good slidability of the guide means in the slide bearing sheath, with low friction losses, but also sufficient tightness of the slide bearing. The angular profile of the governor rod, which has proved to be advantageous, can be retained without alteration. Any modifications that may be needed in the governor rod profile itself will not impair the tightness of the point where the governor rod emerges from the pump housing.

Advantageous embodiments of the invention are disclosed herein.

One advantageous embodiment has the result that an unavoidable deflection of the profiled governor rod and the slight canting of the governor rod caused thereby do not result in an impairment of the slidability or the seal of the guide means embodied as a guide ring for the profiled governor rod in the slide bearing sheath.

In another advantageous embodiment of the invention it is possible in a simple manner, without altering the profiled governor rod structurally, to join the guide ring to the governor rod and simultaneously to effect a coupling element for transmitting the forces of the final control element and restoring forces to the governor rod.

In still another advantageous embodiment of the invention the cardan coupling between the supporting bolt, passing with a large amount of radial play through the inside of the guide ring, and the guide ring permits canting of the governor rod or of the supporting bolt relative to the slide bearing axis over a relatively wide range, especially if the coupler pins of the supporting bolt are themselves supported with a cardan joint. The term "cardan coupling" is understood here to mean a connection between the supporting bolt and the guide ring such as to enable canting of the supporting bolt and the profiled governor rod relative to the slide bearing axis in such a manner that the axes of the supporting bolt and the profiled regulating rod can describe a three-dimensional cone.

The elasticity of the coupler disc according to another embodiment of the invention also represents a sort of cardan coupling, although only for small deflections on the part of the supporting bolt and/or the governor rod, because the coupler disc is compressible on one side and thus permits a slight canting of the supporting bolt and/or the profiled governor rod.

In addition to the slide bearing guide sealing off the interior of the pump housing with respect to the final control element, additional sealing means are provided for the stop position of the profiled governor rod, which is assumed especially when the engine is shut off; these additional sealing means also prevent a slow leak of oil into the final control element.

A governor rod bearing having a reduced diameter and thus performing better sealing to prevent the overflow of oil to the final control element is attained as set forth herein.

The invention will be better understood and further objects and advantages thereof will become more apparent from the ensuing detailed description of preferred embodiments taken in conjunction with the drawings.

Figure 2:
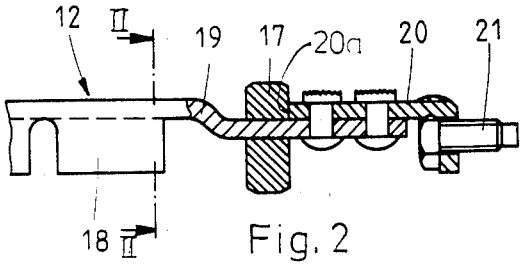
FIG. 2 is a view in the direction of arrow A in FIG. 1 of an end, oriented toward the final control element, of a profiled governor rod of the fuel injection pump of FIG. 1.

FIG. *2a* illustrates a cross section through the control rod along lines II—II of FIG. 2.

Figure 1:
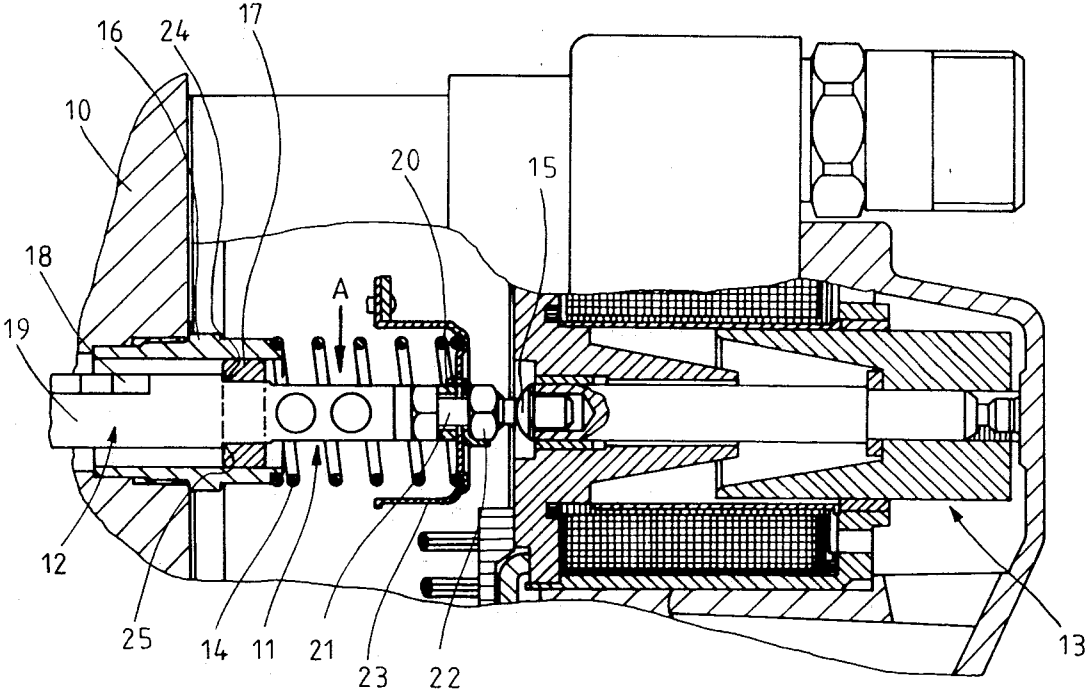
FIG. 1 is a fragmentary longitudinal section of a pump housing having an electromagnetic final control element flanged to it and belonging to a fuel injection pump.
Figure 3:
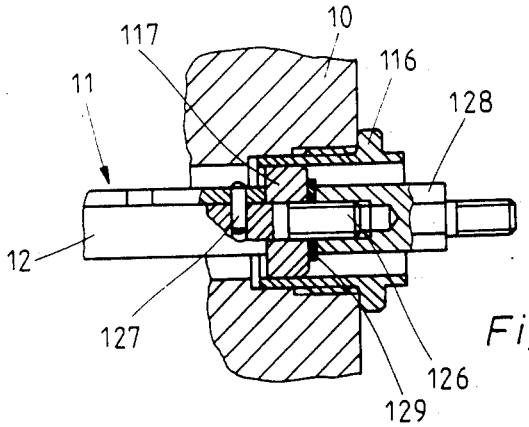
Figure 4:
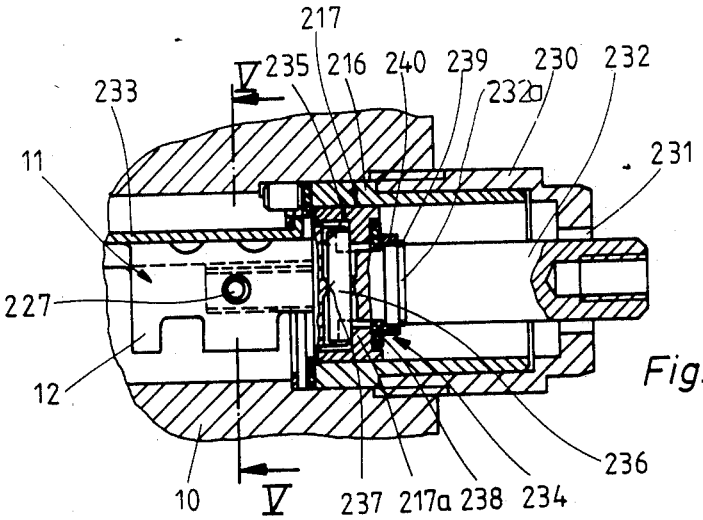
Figure 5:
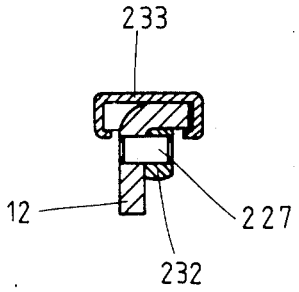
Figure 6:
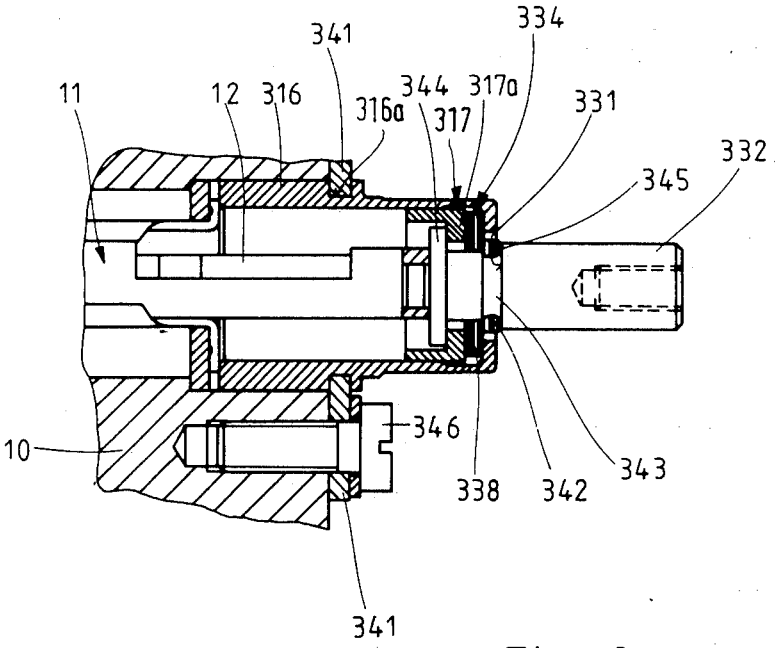
Figure 7:
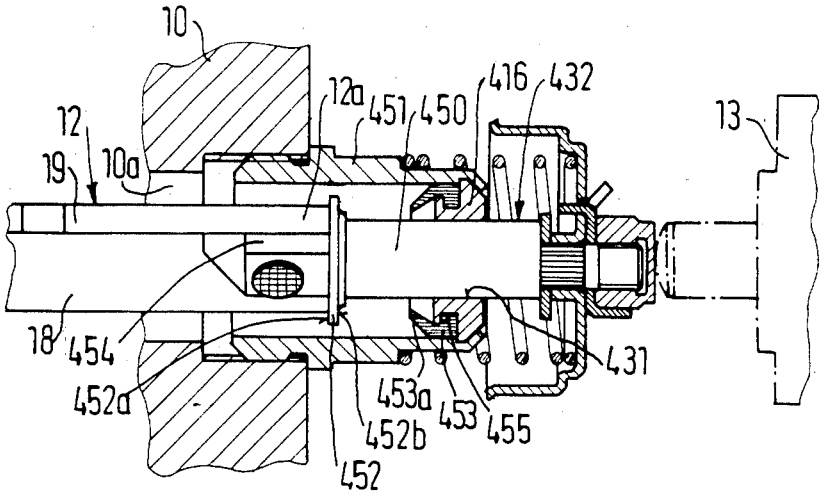

FIG. 3 is a longitudinal section of a passage of the profiled governor rod through the pump housing of the fuel injection pump of FIG. 1 according to a second exemplary embodiment;

FIG. 4 is a longitudinal section of the passage of the profiled governor rod through the pump housing according to a third exemplary embodiment;

FIG. 5 is a section taken along the line V—V of FIG. 4;

FIG. 6 is a longitudinal section of a passage of the profiled governor rod through the pump housing according to a fourth exemplary embodiment; and FIG. 7 is a longitudinal section according to FIG. 3, but in accordance with a fifth exemplary embodiment.

DESCRIPTION OF THE PREFERRED EMBODIMENTS

The fuel injection pump for an internal combustion engine of FIG. 1, only a relatively small detail of which is shown, is a generally well known fuel injection pump, for instance such as that described in U.S. Pat. No.

3,804,559. At least one pump cylinder is disposed in the pump housing 10, and a pump piston having oblique control edges is guided in this cylinder. The angular adjustment or rotation of the pump piston, which serves to vary the effective supply stroke, is effected by means of a so-called supply quantity adjusting member 11. To this end, the supply quantity adjusting member 11 has a governor rod 12 with an angular profile, which along one end engages the pump piston in order to rotate it and on the other end is acted upon by a final control element 13. In accordance with the control signals delivered to the final control element by a regulator, the final control element 13 effects a displacement of the governor rod 12 counter to the force of a restoring spring 14 and thus effects the rotational adjustment of the pump piston.

For the purpose of axial displacement the governor rod 12 is axially displaceably supported in the pump housing 10, specifically at both ends of the pump housing. At the support location oriented toward the final control element 13, the governor 12 is extended out of the pump housing 10 and acted upon on its end by an actuating tappet 15 of the final control element 13, which in this case is embodied electromagnetically.

For supporting the governor rod 12 at the point where it emerges from the pump housing, a cylindrical slide bearing sheath 16 is secured in the pump housing, in this case by screwing a section of the slide bearing sheath 16 having an external thread into the end of the pump housing 10. A cylindrical guide ring 17 for the governor rod 12 is displaceably disposed, with the minimum possible play, in the slide bearing sheath 16. The guide ring 17 is firmly secured to the profiled governor rod, surrounds it in a sealing manner, and thus serves as its guide means.

Figure 2A:
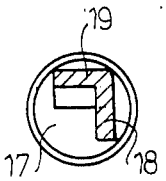

An exemplary embodiment of the governor rod 12 is shown in FIGS. 1 and 2 and 2*a*. As shown, the governor rod includes a rectangular main body portion 19 to which has been secured a downwardly extended side rail 18 which is recessed along its length in order to adjust the pump piston.

The main body portion 19 is bent along one end to provide a free or shank end which extends beyond the side rail 18. An angular coupling element 20 is riveted to the shank end. The free end of coupling element 20 carries a threaded bolt 21 which extends in the displacement direction of the governor rod. The threaded end of the threaded bolt 21 is engaged by the actuating tappet 15 of the final control element 13. An abutment cap 23 for the restoring spring 14 is also secured on the threaded bolt 21 by means of a nut 22 which also secures the bolt to the coupling element. The restoring spring 14 is supported at one end on the bottom of the abutment cap 23 and on the other on the front end of the slide bearing sheath 16 and accordingly presses the front end of the threaded bolt 21 against the actuating tappet 15.

In this embodiment of the governor rod 12, the guide ring 17 is firmly seated upon the shank end of the main body portion 19 of the angular profile, firmly surrounding and sealing it. The guide ring is supported at one end adjacent the front end 20*a* of the coupling element 20 and on the other end of an upper and lower shoulder 24 and 25, respectively, of the main body portion 29 (FIG. 1).

In the exemplary embodiment and in proximity to where the profiled governor rod 12 emerges from the pump housing shown in FIG. 3, a slide bearing sheath 116 is again screwed into the end of the pump housing 10. The guide ring 117 guided with little play in the slide bearing sheath 116 is seated on a threaded bolt 126, which is secured on the end of the governor rod. The fastening is effected here by means of a hole-and-pin connection 127. The guide ring 117 is seated substantially without radial play on the threaded bolt 126 and is pressed against the end of the governor rod by means of a threaded nut 128 screwed onto the threaded bolt 126. A sealing disc 129 is disposed between the ends of the threaded nut 128 and the guide ring 117. The axial length of the guide ring 117 is designed such that in the event of canting of the governor rod 12, and perhaps of the threaded bolt 126 as well, tilting of the guide ring in the slide bearing sheath 116 cannot occur.

In the exemplary embodiment and in proximity to where the profiled governor rod 12 emerges from the pump housing 10 according to FIGS. 4 and 5, the slide bearing sheath 216 is secured by means of a sleeve-nut-like cap 230 screwed into the pump housing 10. On the front end, the cap 230 has a passageway opening 231 for a supporting shaft 232. The supporting shaft 232 is again joined via a hole-and-pin connection 227 to the end of the governor rod 12, which—as shown in FIG. 5—is additionally guided in a U-shaped guide rail 233 extending in the pump housing 10. The guide ring 217, which again slides with little play in the slide bearing sheath 216, surrounds the supporting shaft 232 with relatively large radial play, an elastic seal 234 being disposed between the supporting shaft 232 and the guide ring 217. The guide ring 217 and the supporting shaft 232 are cardan coupled; that is, it is possible for the governor rod 12 to be canted to such an extent relative to the axis of the supporting shaft 232 that the axis of the governor rod 12 is capable of describing a conical surface. The same naturally applies in the event of canting of the supporting shaft 232 relative to the governor rod 12. This cardan coupling is realized here by means of a transverse bore 235 and a transverse pin 236 which rests loosely in the transverse bore 235. The transverse bore 235 has at its center a very narrow annular rib 237 standing away from the bore wall, and the transverse pin 236 rests on this annular rib 217*a*, while in the remaining area of the transverse bore 235 the transverse pin 236 is freely movable in a radial direction. The ends of the transverse pin 236 which protrude from the transverse bore 235 rest on one flank of an annular rib 217*a* which protrudes from the inner wall of the guide ring 217 toward the supporting shaft 232. The elastic seal 234 is realized by means of an elastic coupler disc 238, which is pressed against the other flank of the annular rib 217*a* of the guide ring 217 by means of a snap ring 239 retained in a groove 232*a* of the supporting shaft 232. The guide ring 217 is thus joined to the supporting shaft 232 by means of the transverse pin 236 and the coupler disc 238. The length of the cap 230 is selected such that in one end position, the so-caled stop position, of the governor rod 12 the coupler disc 238 seals off the passageway opening 231. The size of the passageway opening 231 is arranged so that a support ring 240 which is disposed between the snap ring 239 and the coupler disc 238 and is seated on the circumference of the supporting shaft 232 is capable of entering into the passageway opening therein.

A simplified type of cardan coupling between the supporting shaft and the guide ring is shown in the exemplary embodiment and in proximity to where the profiled governor rod emerges from the pump housing according to FIG. 6. Here the slide bearing sheath 316 is embodied in cap-like form and has a central passageway opening 331 for a supporting shaft 332 joined to the governor rod 12. The slide bearing sheath 316 is retained in the pump housing 10 by means of clamping elements 341, which engage a circumferential groove 316*a* of the slide bearing sheath and are in turn secured to the end of the pump housing 10 by screws 346. The coupling between the supporting shaft 332 and the guide ring 317, the latter being axially displaceable without radial play in the slide bearing sheath 316, is effected on the one hand by means of an elastic coupler disc 338 and on the other hand by an annular protrusion 344 on the circumference of the supporting shaft 332. The elastic coupler disc 338 is firmly seated on the supporting shaft 332 and with an annular bulge 342 engages an annular groove 343 of the supporting shaft 332, thereby forming a seal 334. The annular groove 343 is defined by an annular shoulder 345. The coupler disc 338 rests on the end of the guide ring 317, while the annular protrusion 344 rests on the bottom 317*a* of the cup-shaped guide ring 317. In the manner of a cardan coupling, the elasticity of the coupler disc 338 enables the limited canting of the governor rod axis relative to the axis of the supporting shaft 332 in an arbitrary direction. The length of the slide bearing sheath 316 is again dimensioned such that in one end position of the governor rod 12, the elastic coupler disc 338 covers the passageway opening 331, whereupon the annular shaft 342 enters into the passageway opening 331.

In the fifth exemplary embodiment according to FIG. 7, shown in terms of a cross section through the point where the profiled governor rod 12 emerges from the pump housing 10, the governor rod guide means comprises a bolt-like cylindrical guide section 450 of a supporting shaft 432 secured to an end 12*a* nearer the final control element of the profiled governor rod 12. A closure cap 451 screwed into the end of the pump housing 10 has on its end facing the final control element 13, indicated by dot-dash lines, a slide bearing sheath 416 in the form of a bottom portion protruding inward toward the guide section 450 of the supporting shaft 432; like the guide rings of the foregoing examples, which are considered equivalent to it, this slide bearing sheath 416 has a relatively short, tilt-proof minimal axial length. The slide bearing sheath 416 is provided with a central through opening 431, which because of an internal slide bearing fitting seals off an interior 10*a* of the pump housing 10, which receives at least the governor rod 12, from the final control element 13 and guides the governor rod 12 by means of the guide section 450, which is guided in this through opening 431, during the adjusting movements of the governor rod 12. At its end 12*a* toward the final control element, the profiled governor rod 12, which as in the foregoing exemplary embodiments is embodied as a bent governor rod, receives a securing tang 454 of the supporting shaft 432 which tang is encompassed by one of the two shanks 18 and 19 of the governor rod 12. The securing tang 454 is rivited to the end 12*a* of the governor rod 12 toward the final control element and may additionally be welded thereto, if desired for safety reasons. An annular collar 452 located between the securing tang 454 and the guide section 450 of the supporting shaft 432 rests with its one shoulder 452*a* on the end face of the governor rod end 12*a*.

In the exemplary embodiment described in FIG. 7, the slide bearing sheath 416 embodied as a bottom part of the closure cap 451 is fabricated as a separate part and is joined to the closure cap by a jointed-flange connection. The slide bearing sheath 416, in an annular groove 455, receives an annular bead-like ring seal 453 embodied as a lip seal. A sealing lip 453*a* of the ring seal 453 is inclined toward the guide section 450 of the supporting shaft 432 and points away from the slide bearing sheath 416 toward the interior 10*a* of the pump housing 10. The sealing lip 453*a* forms, with the other shoulder 452*b* of the annular collar 452, an additional sealing means, which is for example effective when the engine is shut off. This prevents the overflow of oil from the interior 10*a* of the pump housing 10 to the corresponding interior of the final control element 13, because then the profiled governor rod 12 is in its terminal position (not shown) that is shifted with respect to the final control element 13 and is designated as a stop position. In this terminal position, the shoulder 452*b* rests firmly against the sealing lip 453*a*, so that even with an oil-filled injection pump or at a corresponding oblique position of the pump, any leakage of oil whatever into the final control element is precluded. The relatively small guide diameter in the through opening 431 provided in this variant embodiment assures good sealing to prevent an oil overflow during operation as well.

In all the exemplary embodiments, the radial play of the guide means 17, 117, 217, 317, 450, which is axially displaceable in the slide bearing sheath 16, 116, 216, 316, 416, is intended to be as small as possible, yet assure a satisfactory sliding displacement of the guide means 17, 117, 217, 317, or 450, in the slide bearing sheath 16, 116, 216, 316, or 416. While in the exemplary embodiments according to FIGS. 4–6 the radial play should not exceed a few hundredths of a millimeter, in the exemplary embodiments of FIGS. 1–3 or 7 it may amount to up to 0.1 mm.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A fuel injection pump for internal combustion engines, comprising a pump housing and a supply quantity adjusting member adjustable by an electrically controlled final control element, said supply quantity adjusting member having a profiled governor rod supported in said pump housing, said profiled governor rod includes a main body portion with a shank end in proximity to said final control element, said rod further having an end arranged to extend out of the pump housing toward the final control element, a cylindrical slide bearing sheath secured in said pump housing in proximity to said profiled governor rod, and a displaceably disposed cylindrical governor rod guide ring having a tilt-proof minimal axial length firmly seated on said shank end of said main body portion and secured to said profiled governor rod to close off said governor rod in a sealing manner relative to said cylindrical slide bearing sheath and to the final control element to thereby achieve the least possible radial play in the slide bearing sheath to prevent an overflow of oil from said pump housing to the final control element and a coupling element secured to said shank end of said profiled governor rod for transmitting adjusting forces to said profiled governor rod and further that said guide ring is secured to said shank end between a front face of said coupling element and a shoulder provided on said main body portion of said profiled governor rod.

2. A fuel injection pump for internal combustion engines, comprising a pump housing and a supply quantity adjusting member adjustable by an electrically controlled final control element, said supply quantity adjusting member having a profiled governor rod supported in said pump housing, said rod further having an end arranged to extend out of the pump housing toward the final control element, a cylindrical slide bearing sheath secured in said pump housing in proximity to said profiled governor rod, and a displaceably disposed cylindrical governor rod guide embodied as a guide ring having a tilt-proof minimal axial length and secured to said profiled governor rod to close off said governor rod in a sealing manner relative to said cylindrical slide bearing sheath and to the final control element to thereby achieve the least possible radial play in the slide bearing sheath to prevent an overflow of oil from said pump housing to the final control element, a threaded shaft secured on said one end of said profiled governor rod and further that said guide ring is received upon said threaded shaft and arranged to be pressed against said one end of said governor rod by means of a threaded nut and a sealing disc interposed between said guide ring and said threaded nut.

3. A fuel injection pump for internal combustion engines, comprising a pump housing and a supply quantity adjusting member adjustable by an electrically controlled final control element, said supply quantity adjusting member having a profiled governor rod supported in said pump housing, said rod further having an end arranged to extend out of the pump housing toward the final control element, a cylindrical slide bearing sheath secured in said pump housing in proximity to said profiled governor rod, and a displaceably disposed cylindrical governor rod guide means and secured to said profiled governor rod to close off said governor rod in a sealing manner relative to said cylindrical slide bearing sheath and to the final control element to thereby achieve the least possible radial play in the slide bearing sheath to prevent an overflow of oil from said pump housing to the final control element, and a supporting shaft is secured on said profiled governor rod and further that said guide means consist of a guide ring encompassing said supporting shaft with radial play and being cardan coupled therewith without axial play, and further that an elastic seal is interposed between said supporting shaft and said guide ring.

4. A fuel injection pump for internal combustion engines, comprising a pump housing and a supply quantity adjusting member adjustable by an electrically controlled final control element, said supply quantity adjusting member having a profiled governor rod supported in said pump housing, said rod further having an end arranged to extend out of the pump housing toward the final control element, a cylindrical slide bearing sheath secured in said pump housing in proximity to said profiled governor rod, and a displaceably disposed cylindrical governor rod guide means and secured to said profiled governor rod to close off said governor rod in a sealing manner relative to said cylindrical slide bearing sheath and to the final control element to thereby achieve the least possible radial play in the slide bearing sheath to prevent an overflow of oil from said pump housing to the final control element, said governor rod guide means comprises a bolt-like cylindrical guide section of a supporting shaft secured on an end nearer the final control element of the profiled governor rod and that the slide bearing sheath has a tilt-proof minimal axial length and is embodied by a bottom part, protruding inward toward the guide section, of a closure cap secured at the point where the profiled governor rod emerges from the pump housing, and said supporting shaft has a radially protruding annular collar on an end of its guide section nearer the governor rod, which in one terminal stop position of the profiled governor rod shifted with respect to the final control element rests on a ring seal secured in the vicinity of the transition from the closure cap to the slide bearing sheath and additionally seals off an interior of the pump housing which interior receives the profiled governor rod with respect to the final control element.

5. A fuel injection pump as defined by claim 3, further wherein said cardan coupling comprises coupling elements arranged to offstand radially from said supporting shaft, said coupling elements arranged to rest on at least said one end face of said guide ring, and further having a coupler disc seated upon said supporting shaft, said coupler disc arranged to rest on said other end face of the guide ring, and further that said coupler disc is clamped against said guide ring by a support ring positioned on said supporting shaft.

6. A fuel injection pump as defined by claim 5, further wherein said coupler disc includes a sealing zone arranged to rest in an annular groove on said supporting shaft and further that said sealing zone rests on an annular shoulder, axially defining said annular groove, of said supporting shaft.

7. A fuel injection pump as defined by claim 5, further wherein said coupler elements comprise an annular protrusion of said supporting shaft.

8. A fuel injection pump as defined by claim 5, further wherein said coupler elements further include a transverse pin having protruding end portions and said supporting shaft further includes a transverse bore, said end portions arranged to protrude from said bore.

9. A fuel injection pump as defined by claim 8, further wherein said supporting shaft has an axis and said transverse pin is cardan supported therein.

10. A fuel injection pump as defined by claim 9, further wherein said transverse bore has a wall and said transverse pin rests on a very narrow annular rib standing away from said bore wall in the center of said transverse bore and said transverse pin further arranged to rest loosely, with radial play, in the area remaining in said transverse bore.

11. A fuel injection pump as defined by claim 8, further wherein said coupler disc and said protruding end portions of said transverse pin rest on opposite flanks of an annular rib which protrude from the said guide ring toward said supporting shaft and further that said coupler disc is clamped on said supporting shaft against said annular rib by means of a snap ring and a support ring disposed between said snap ring and said coupler disc.

12. A fuel injection pump as defined by claim 5, further wherein said supporting shaft is arranged to receive a slide bearing sheath provided with a central passageway opening, and further that the length of said slide bearing sheath is dimensioned such that in one end position of the profiled governor rod said coupler disc seals off a passageway opening in said slide bearing sheath.

13. A fuel injection pump as defined by claim 11, further wherein said slide bearing sheath is secured by means of a sleeve-nut-like cap into said pump housing said cap further having a central passageway opening for said supporting shaft, and further that said cap has a length which is dimensioned so that in one end position (stop position) of said profiled governor rod said coupler disc covers said passageway opening.

14. A fuel injection pump as defined by claim 1, characterized in that the governor rod guide means comprises a bolt-like cylindrical guide section of a supporting shaft secured on an end nearer the final control element of the profiled governor rod and that the slide bearing sheath has a tilt-proof minimal axial length and is embodied by a bottom part, protruding inward toward the guide section, of a closure cap secured at the point where the profiled governor rod emerges from the pump housing.

* * * * *